United States Patent [19]

Yamashita et al.

[11] Patent Number: 4,660,153

[45] Date of Patent: Apr. 21, 1987

[54] FUEL SUPPLYING APPARATUS

[75] Inventors: Kazuhisa Yamashita; Yoshio Shibata, both of Kawasaki; Shigemi Komukai, Yokohama, all of Japan

[73] Assignee: Tokico Ltd., Kawasaki, Japan

[21] Appl. No.: 621,048

[22] Filed: Jun. 15, 1984

[30] Foreign Application Priority Data

Jun. 17, 1983 [JP] Japan ..... 58-109025

[51] Int. Cl.[4] ..... G10L 5/00

[52] U.S. Cl. ..... 364/513.5; 364/465; 381/51; 222/39; 194/350

[58] Field of Search ..... 381/51-53; 364/513.5, 465; 340/568, 692; 222/23, 36, 39; 194/350; 40/584

[56] References Cited

U.S. PATENT DOCUMENTS 3,935,435 1/1976 Greenwood ..... 364/465
4,369,334 1/1983 Nakatani et al. ..... 381/51
4,454,670 6/1984 Bachmann et al. ..... 194/350 X

FOREIGN PATENT DOCUMENTS 16791 12/1966 Japan .
29673 3/1974 Japan .
74490 11/1979 Japan .

*Primary Examiner*—E. S. Matt Kemeny
*Attorney, Agent, or Firm*—Michael N. Meller

[57] ABSTRACT

A fuel supplying apparatus comprises a fuel supplying nozzle having an opening and closing valve, a fuel supplying arrangement for supplying a fuel to the fuel supplying nozzle, a nozzle hook onto which the fuel supplying nozzle is hooked when the fuel supplying nozzle is not in use, a flow quantity signal generator for generating a flow quantity signal responsive to a quantity of fuel which has been supplied from the fuel supplying arrangement, a speech generating device for generating a speech which is in accordance with a completion of a fuel supplying operation, responsive to a hooking of the fuel supplying nozzle onto the nozzle hook after the fuel supplying operation is completed, and a resetting circuit for stopping the generation of speech by the speech generating means and for resetting the fuel supplying apparatus to a state where a subsequent fuel supplying operation can be started, responsive to an unhooking of the fuel supplying nozzle from the nozzle hook before the generation of speech by the speech generating means is completed.

6 Claims, 6 Drawing Figures

FUEL SUPPLYING APPARATUS

BACKGROUND OF THE INVENTION

The present invention generally relates to fuel supplying apparatuses, and more particularly to a fuel supplying apparatus designed to automatically greet a customer and inform him of the result of a fuel supplying operation, for example, by speech.

Conventionally, as one type of a fuel supplying apparatus, there was a fixed type measuring device. The only information this fixed type measuring device gave to a customer, was a visual display of the quantity of supplied fuel. In order to improve the service to the customer and provide a confirmation of the quantity of supplied fuel, an improved fuel supplying apparatus was previously proposed in a Japanese Utility Model Application No. 57-153846 which has now been laid open as Japanese Laid-Open Utility Model Application No. 59-57399. According to this previously proposed apparatus, the quantity of supplied fuel is automatically informed to the customer by speech, by carrying our a speech synthesis. This previously proposed apparatus also has a function to automatically give greetings by speech to the customer, by saying "WELCOME" before the fuel supplying operation is carried out and saying "THANK YOU VERY MUCH" after the fuel supplying operation is carried out, for example.

However, in this previously proposed apparatus, the apparatus gives the sequence of information including the "WELCOME" greeting, the quantity of supplied fuel, and the "THANK YOU" greeting, for each vehicle, even when the apparatus must continuously carry out the fuel supplying operation with respect to a plurality of successively incoming vehicles. Thus, a fuel supplying operation could only be carried out with respect to a subsequent vehicle only after the sequence of information had been given to the first vehicle, and there was a problem in that the fuel supplying operation could not be carried out swiftly. In addition, the quantity of supplied fuel and the "THANK YOU" greeting which were given to the previous vehicle, was also given to the vehicle which followed. As a result, there was a problem in that the operator of the fuel supplying apparatus and the customer may become confused by the information which was intended for the previous vehicle but continued to be given to the following vehicle. In other words, the operator and the customer may erroneously take the quantity of supplied fuel which was given to the previous vehicle, as if it were intended for this following vehicle.

SUMMARY OF THE INVENTION

Accordingly, it is a general object of the present invention to provide a novel and useful fuel supplying apparatus in which the problems described heretofore have been eliminated.

Another and more specific object of the present invention is to provide a fuel supplying apparatus of the type which automatically greets a customer and informs him of the quantity of supplied fuel, for example, by speech. The apparatus according to the present invention is designed so that a speech generating operation intended for one fuel supplying operation so as to inform the quantity of supplied fuel, give greetings, or the like, is stopped when another fuel supplying operation is to be carried out immediately after the one fuel supplying operation is completed, so that the subsequent fuel supplying operation will not be interfered by the information given with respect to the previous fuel supplying operation. According to the apparatus of the present invention, it is possible to prevent a misunderstanding of the quantity of supplied fuel, and the fuel supplying operation can be carried out successively and swiftly.

Still another object of the present invention is to provide a fuel supplying apparatus which is designed to discriminate the state of a fuel supplying nozzle after a fuel supplying operation is completed. According to the apparatus of the present invention, a speech generating process is performed when the fuel supplying nozzle is hooked onto a nozzle hook. On the other hand, the speech generating process is terminated when the fuel supplying nozzle is once hooked onto the nozzle hook and is thereafter unhooked within a short period of time, so that the apparatus can start a subsequent fuel supplying operation.

Other objects and further features of the present invention will be apparent from the following detailed description when read in conjunction with the accompanying drawings.

DETAILED DESCRIPTION

Figure 1:
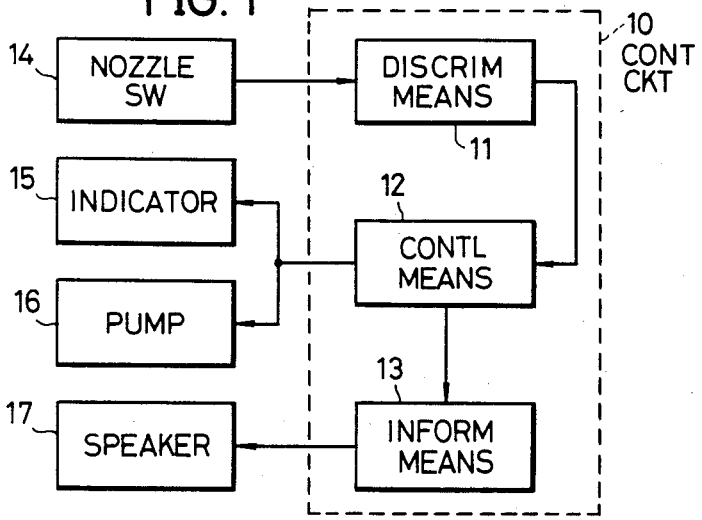
FIG. 1 is a general functional block diagram showing basic functions of a fuel supplying apparatus according to the present invention.

FIG. 1 is a general functional block diagram showing the basic functions of a fuel supplying apparatus according to the present invention. A control circuit 10 which constitutes an essential part of the fuel supplying apparatus according to the present invention, comprises a discriminating means 11, a control means 12, and an informing means 13. The discriminating means 11 discriminates whether a fuel supplying nozzle is unhooked from a nozzle hook, responsive to a signal from a nozzle switch 14. The informing means 13 informs a quantity of supplied fuel and gives greetings or the like by speech, through a speaker 17. The control means 12 drives a pump 16 when the fuel supplying nozzle is unhooked from the nozzle hook in a waiting state of the fuel supplying apparatus, and starts a fuel supplying operation by operating a flowmeter (not shown) and an indicator 15. The control means 12 operates the informing means 13 when the fuel supplying nozzle is hooked onto the nozzle hook after the fuel supplying operation is completed. When the fuel supplying nozzle is hooked onto the nozzle hook after the fuel supplying operation is completed and the fuel supplying nozzle is thereafter unhooked from the nozzle hook within a short period of time so as to start a subsequent fuel supplying operation, the control means 12 stops the operation of the informing means 13 so that the subsequent fuel supplying operation can be started.

Figure 2:
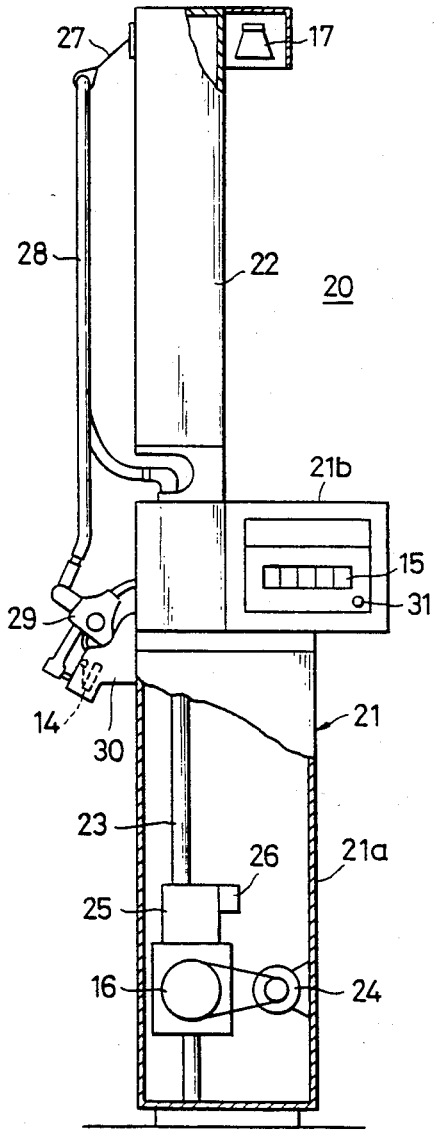
FIG. 2 is an external elevation, with a part cut away, showing an embodiment of a fuel supplying apparatus according to the present invention.

An embodiment of an external appearance of the fuel supplying apparatus according to the present invention, is shown in FIG. 2. In FIG. 2, those parts which are the same as those corresponding parts in FIG. 1, are designated by the same reference numerals. A main part 21 of a fuel supplying apparatus 20, is made up of a measuring part 21*a* and an indicator part 21*b*. A mast 22 is provided on the main part 21, and the speaker 17 is mounted on an upper part of the mast 22. A pipe arrangement 23 is disposed within the measuring part 21*a* of the main part 21. The pump 16 which is operated by a motor 24, and a flowmeter 25, are located at an intermediate position in the pipe arrangement 23. The flowmeter 25 comprises a flow quantity generator 26 which generates a pulse signal proportional to the flow quantity. The indicator 15 is provided within the indicator part 21*b* of the main body 21. The indicator 15 displays a flow quantity signal which is obtained from the flow quantity generator 26 through a flow quantity processing part (not shown in FIG. 2) within the indicator part 21*b*. A music selection switch 31 is located on the indicator 15.

A sash cord 27 is provided on the upper part of the mast 22. This sash cord 27 is connected to a pulling mechanism (not shown) within the mast 22. A hose 28 has its base end connected to the pipe arrangement 23 and its free end connected to a fuel supplying nozzle 29, and hangs from the sash cord 27. The fuel supplying nozzle 29 is hooked onto an accommodating part (nozzle hook) 30. The nozzle switch 14 which opens and closes responsive to the hooking and unhooking of the fuel supplying nozzle 29 with respect to the accommodating part 30, is provided within the accommodating part 30.

As will be described later on in the specification, the flow quantity processing circuit within the indicator part 21*b*, supplies a predetermined control signal and data to a speech processing part within the mast 22, so as to drive the speaker 17 and give greetings and inform the quantity of supplied fuel or the like by a synthesized speech.

Figure 3:
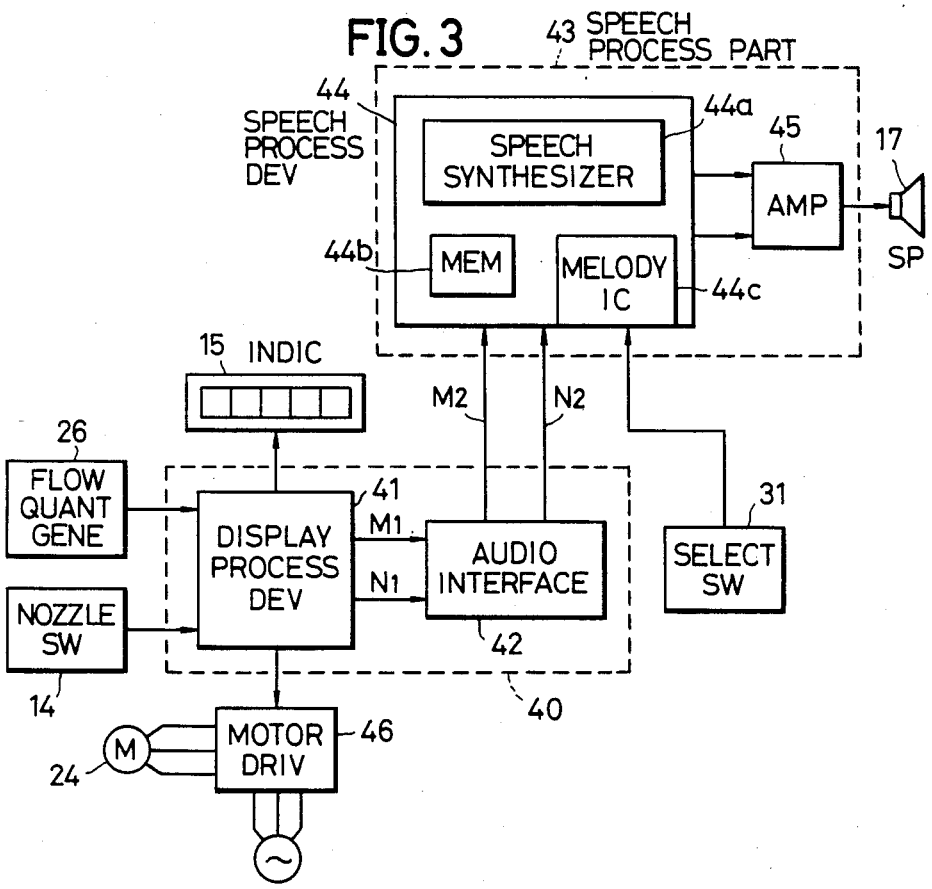
FIG. 3 is a systematic block diagram showing an embodiment of an essential part of the fuel supplying apparatus according to the present invention.

Next, description will be given with respect to the operations and functions of the flow quantity processing part and the speech processing part, by referring to FIG. 3. In FIG. 3, those parts which are the same as those corresponding parts in FIGS. 1 and 2, are designated by the same reference numerals.

A flow quantity processing part 40 within the indicator part 21*b*, comprises a display processing device 41 and a speech interface 42. A speech processing part 43 within the mast 22, comprises a speech processing device 44 and an amplifier 45. The speech processing device 44 has a speech synthesizer 44*a*, a memory 44*b* which stores phrases of speech, and a melody integrated circuit (IC) 44*c* which generates melodies. The melody IC 44*c* may be built into the memory 44*b*. The melody generated from the melody IC 44*c* is changed responsive to the pushing of the music selection switch 33, and the music selection is carried out in a predetermined sequence every time the music selection switch 33 is pushed. A motor driving circuit 46 is operated responsive to a signal from the display processing device 41, and starts and stops the motor 24.

First, description will be given with respect to a normal fuel supplying operation.

When the fuel supplying nozzle 29 is unhooked from the nozzle accommodating part 30 so as to start a normal fuel supplying operation, the nozzle switch 14 closes, and a driving signal is supplied to the motor driving circuit 46 from the display processing device 41 so as to start the motor 24. At the same time, a reset signal is supplied to the indicator 15 from the display processing device 41, so as to reset the previous display value in the indicator 15.

When the fuel supplying nozzle 29 is inserted into a fuel tank of a vehicle and is opened, the fuel is pumped out of a storage tank of the fuel supplying station and flows through the flowmeter 25. The flow quantity generator 26 generates a pulse signal in accordance with the quantity of supplied fuel, and the quantity of supplied fuel which is calculated in the display processing device 41 is displayed on the indicator 15.

On the other hand, the display processing device 41 supplies a control signal to the audio interface 42 through a line M1, and the melody IC 44*c* is driven by the audio interface 42 through a line M2.

Operations which follow, will now be described by referring to the timing charts shown in FIG. 4. When the fuel supplying nozzle 29 is unhooked from the accommodating part 30 as described before, an output signal a of the nozzle switch 14 rises to a high level as indicated by $a_1$ in FIG. 4(A). At the same time, a timer is started, and the melody IC 44*c* is driven after a time $t_1$ elapses, as indicated by $b_1$ in FIG. 4(B). As a result, an access is made to the melody IC 44*c* so as to fetch an audio information related to a chime from the melody IC 44*c*, and the chime sound is generated twice through the speaker 17.

Next, the display processing device 41 sets the timer after a time $t_2$ elapses from the time when the generation of the chime is terminated, and supplies a control signal and an address data to the audio interface 42 through a line N1. The audio interface 42 drives the speech synthesizer 44*a* through a line N2, and an access is made to the memory 44*b* so as to fetch from the memory 44*b* a speech information related to a greeting "WELCOME". As a result, the greeting "WELCOME" is generated through the speaker 17 as indicated by $c_1$ in FIG. 4(C). Then, the timer is set after a time $t_3$ elapses from the time when the generation of the greeting "WELCOME" is terminated. This time, a driving signal $b_2$ shown in FIG. 4(B) is supplied to the melody IC 44*c* from the display processing device 41, through the line M1, the audio interface 42, and the line M2, so as to drive the melody IC 44*c*. The melody IC 44*c* generates a melody which is selected by the music selection switch 31. As shown in FIG. 4(D), the melody IC 44*c* may be driven continuously responsive to every pulse in a pulse signal $d_1$ which is generated from the flow quantity generator 26, that is, responsive to the flow velocity of the fuel.

When the fuel supplying nozzle 29 is closed and the fuel supplying operation is completed, the flow quantity generator 26 stops generating the pulse signal. Hence, the display processing device 41 stops generating the driving signal for the melody IC 44*c*. As a result, the melody IC 44*c* stops the operation $b_2$ of generating the melody, after a predetermined time $t_4$ elapses from the time when the driving signal ceases (that is, from the time when the pulse signal $d_1$ ceases), as shown in FIG. 4(B). In a case where the fuel tank of the vehicle becomes filled up, the fuel supplying operation is automatically stopped by a known means. This known means includes a fluid surface detector located at the tip end of the fuel supplying nozzle 29, for detecting that a predetermined quantity of fuel has been supplied. However, such a fluid surface detector often detects air bubbles in the fuel such as gasoline. For this reason, it is often necesssary to continue the fuel supplying operation so that the fuel tank of the vehicle becomes filled up to the limit. In other words, after the fuel supplying nozzle 29 is automatically closed, the operator operates a manual lever on the fuel supplying nozzle 29 so as to supply some more fuel into the fuel tank. In this state, the flow quantity generator 26 again produces the pulse signal $d_2$ as shown in FIG. 4(D). Consequently, a driving signal $b_3$ for the melody IC 44*c* is generated after a delay time $t_5$ from the first generation of the pulse signal $d_2$, with the timing of the timer, as shown in FIG. 4(B). Thus, the selected melody is again generated through the speaker 17.

When the fuel supplying operation is fully completed in this manner, the pulse signal $d_2$ ceases, and the melody which is generated for the second time ceases after a predetermined time delay. The fuel supplying nozzle 29 is hooked onto the accommodating part 30, and the nozzle switch 14 is opened. The output signal a of the nozzle switch 14 thus returns to a low level as indicated by $a_2$ in FIG. 4(A).

The display processing device 41 sets the timer responsive to the low-level signal $a_2$ from the nozzle switch 14. Then, after a delay time $t_6$, the display processing device 41 drives the melody IC 44*c* through the line M1, the audio interface 42, and the line M2, as indicated by $b_4$ in FIG. 4(B). The chime is generated twice, for example, as in the case at the time when the fuel supplying operation was started.

Thereafter, the display processing device 41 produces a control signal and an address data indicative of the audio information which is in accordance with the measured result, through the line N1, the audio interface 42, and the line N2. The control signal and the address data are produced from the display processing device 41 with a timing of the timer, after a time $t_7$ elapses from the time when the generation of the chime for the second time is terminated. As a result, the speech synthesizer 44*a* is driven within a duration indicated by $c_2$ in FIG. 4(C). An access is made to the memory 44*b* so as to fetch a stored phrase, and a synthesized speech such as "SUPPLIED FUEL IS 10.0 LITERS", for example, is generated through the speaker 17 twice. Next, the display processing device 41 produces an address data indicative of the greeting which should be made upon completion of the fuel supplying operation, within the duration $c_2$. As a result, a synthesized speech "THANK YOU VERY MUCH", for example, is generated through the speaker 17, and the fuel supplying operation is terminated.

After the synthesized speech "THANK YOU VERY MUCH" is generated, the display processing device 41 carries out a reset process so as to return the indicator 15 back to the initial state, and also return the circuits within the display processing device 41 back to the respective initial states, and the operation is terminated. In this state, the fuel supplying apparatus is now in a waiting state, waiting for the fuel supplying nozzle 29 to be unhooked from the accommodating part 30 so that the output signal a of the nozzle switch 14 assumes a high level. When the fuel supplying nozzle 29 is again unhooked from the accommodating part 30 so as to start another fuel supplying operation, the output signal a of the nozzle switch 14 assumes a high level, and the indicator 15 is reset. Further, the motor 24 is started.

The operation of the fuel supplying apparatus described heretofore, applies to a case where the fuel supplying operations are to be carried out discontinuously and there is a predetermined duration between one fuel supplying operation and a subsequent fuel supplying operation. Next, description will be given with respect to a case where the fuel supplying operations are to be carried out continuously and one fuel supplying operation is immediately followed by a subsequent fuel supplying operation.

Figure 4:
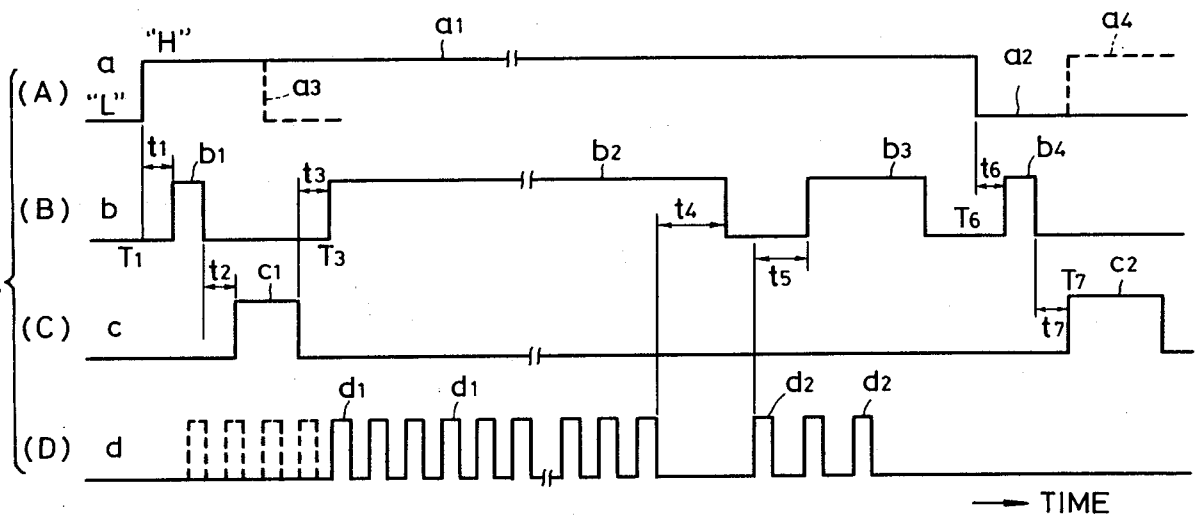
FIGS. 4(A) through 4(D) are time charts for explaining the operation of the aparatus shown in FIG. 3.

In the time chart shown in FIG. 4, the times (durations) $t_1$ through $t_3$ and $t_5$ through $t_7$ are measured by use of the timer. In correspondence with the duration in which the timer is set, the display processing device 41 checks the output signal of the nozzle switch 14 to dermine whether the output signal of the nozzle switch 14 assumes a high level. In other words, the display processing device 41 discriminates whether the fuel supplying nozzle 29 has been unhooked from the accommodating part 30. When the level of the output signal of the nozzle switch 14 changes from a high level to a low level in the duration between a starting point $T_1$ of the duration $t_1$ and a terminal point $T_3$ of the duration $t_3$ as indicated by a phantom line $a_3$ in FIG. 4(A), preparatory operations for resetting the indicator 15 or the like are performed, and the display processing device 41 is returned to the waiting state before the fuel supplying operation was started.

On the other hand, when the level of the output signal of the nozzle switch 14, which has once changed from the high level to the low level, again changes from the low level to the high level in the duration between a starting point $T_6$ of the duration $t_6$ and a terminal point $T_7$ of the duration $t_7$ as indicated by a phantom line $a_4$ in FIG. 4(A), the display processing device 41 is returned to the waiting state and preparatory operations for resetting the indicator 15 or the like are performed. Further, the timing is returned to the initial timing shown in FIG. 4(A) so as to start the subsequent fuel supplying operation. In other words, the operation is started from the process of driving the melody IC 44*c* after the duration $t_1$. In a case where the subsequent fuel supplying operation is started before the speech information concerning the quantity of supplied fuel, greetings, or the like are given with respect to the previous (last) fuel supplying operation, the operation of providing the speech information with respect to the previous fuel supplying operation is not performed. In this case, the subsequent fuel supplying operation is started from the "WELCOME" greeting with respect to the subsequent fuel supplying operation. Accordingly, even when the subsequent fuel supplying operation is started immediately after the previous fuel supplying operation, the speech information with respect to the previous fuel supplying operation will not be given, and the operator or the customer will not be erroneously informed of the quantity of supplied fuel related to the previous fuel supplying operation. In addition, in this case, it is unnecessary to wait until the speech information is given with respect to the previous fuel supplying operation before starting the subsequent fuel supplying operation. As a result, a plurality of successive fuel supplying operations can be performed swiftly without an excessively long interruption between two successive fuel supplying operations.

A known speech synthesizer circuit can be used for the speech synthesizer 44*a*. For example, a combination of known integrated circuit chips HD-38880B, HD- 38881B, and HD-38882B manufactured by Hitachi, Ltd. of Japan may be used for the speech synthesizer 44*a*.

The display processing device 41, the audio interface 42, the speech processing device 44, and the like, may be constituted by a microcomputer, and the operations of the microcomputer will now be described by referring to the flow charts shown in FIGS. 5A and 5B.

Figure 5A:
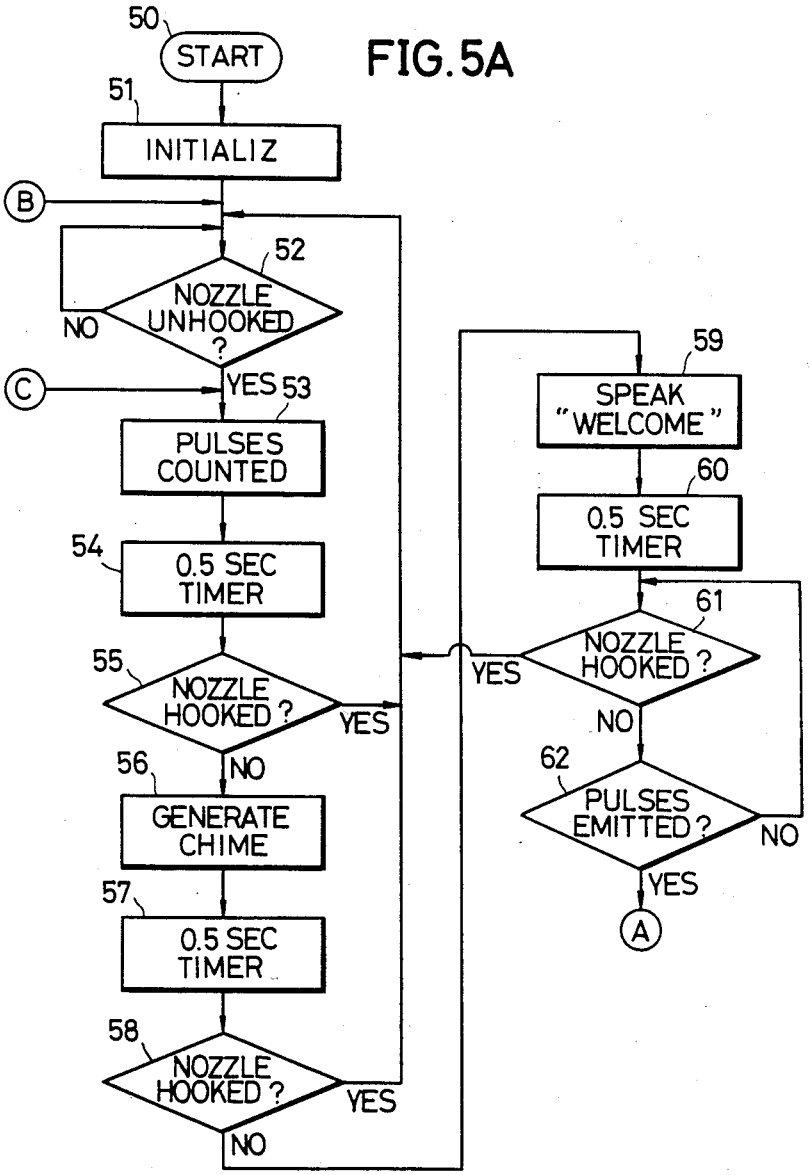
FIGS. 5A and 5B are flow charts for explaining a case where an essential part of the block system shown in FIG. 3 is constituted by a microcomputer.
Figure 5B:
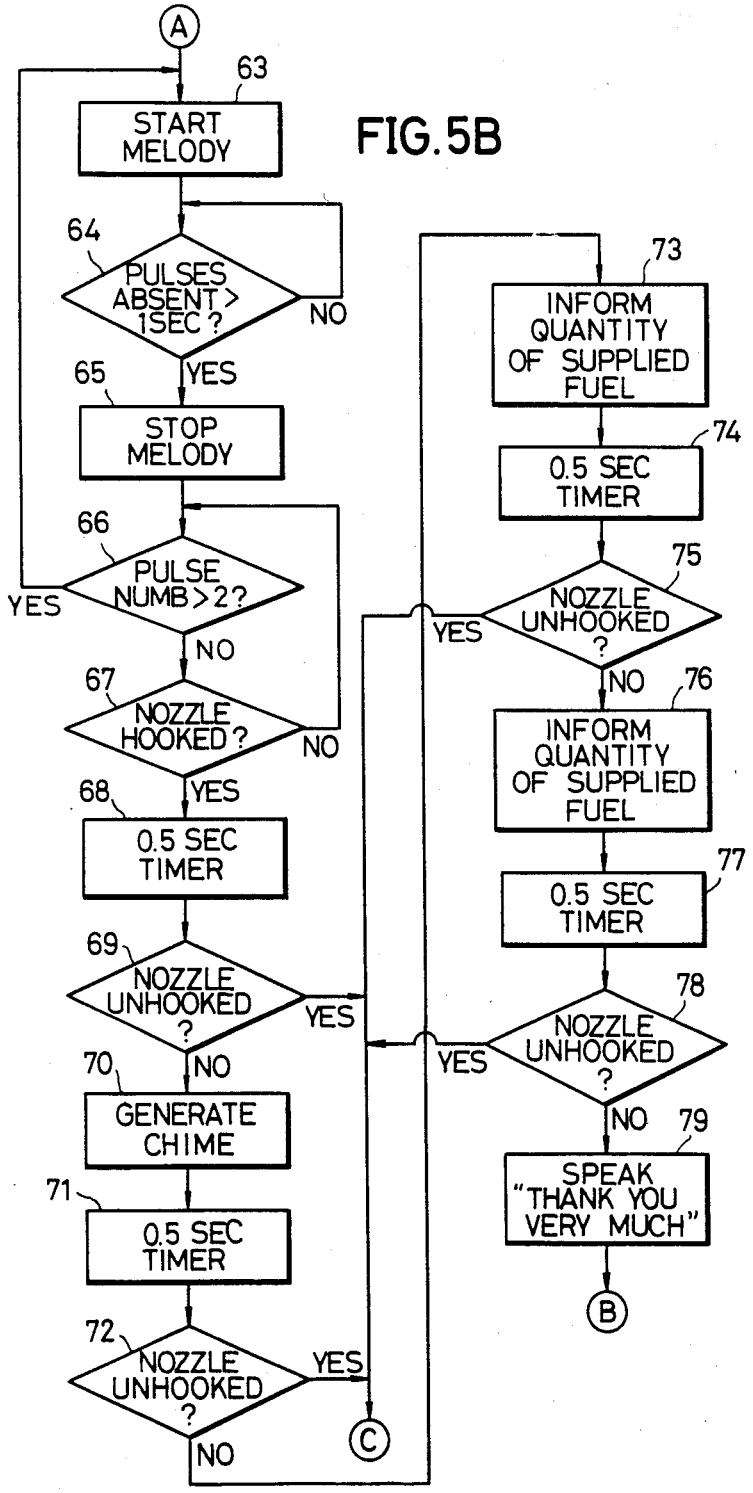

In FIG. 5A, the operation of the microcomputer is started from a step 50. Initialization takes place in a step 51. A step 52 discriminates whether the fuel supplying nozzle 29 has been unhooked from the accommodating part 30. When the discrimination result in the step 52 is NO, the same discrimination is continuously performed in a waiting loop. The discrimination result in the step 52 becomes YES when the fuel supplying nozzle 29 is unhooked from the accommodating part 30, and the operation advances to a step 53. The output signal of the nozzle switch 14 assumes a high level, the previous display value in the indicator 15 is reset, and the pump 16 is driven, when the fuel supplying nozzle 29 is unhooked from the accommodating part 30. Pulses in the pulse signal from the flow quantity generator 26 are counted in the step 53, and the counted value is stored in a predetermined memory region (address FFH, for example) which is utilized as a counter.

When the fuel supplying nozzle 29 is unhooked from the accommodating part 30 and the motor 24 starts to rotate so as to drive the pump 16, the hose 28 slightly expands even in the state before the fuel supplying nozzle 29 is opened from the closed state. Thus, a small quantity of fuel corresponding to the expansion of the hose 28, flows through the flowmeter 25 and several pulses are produced from the flow quantity generator 26. Hence, the several pulses are counted in the step 53 so that these pulses will not be counted in a subsequent step, and so that a subsequent step will not erroneously discriminate that the supply of fuel has started.

A subsequent step 54 sets the timer to 0.5 seconds. After this set time of 0.5 seconds has elapsed, a step 55 discriminates whether the fuel supplying nozzle 29 has been hooked onto the accommodating part 30. In the present embodiment, the counting of the time by the timer and the discrimination on the hooking and unhooking of the fuel supplying nozzle 29, are performed sequentially. However, these steps may be performed in parallel with each other.

When the discrimination result in the step 55 is NO, the melody IC 44*c* is driven so as to generate the chime in a step 56. A step 57 sets the timer to 0.5 seconds, and a step 58 discriminates whether the fuel supplying nozzle 29 has been hooked onto the accommodating part 30, after the time of 0.5 seconds has elapsed. When the discrimination result in the step 58 is NO, the speech synthesizer 44*a* is driven in a step 59, and an access is made to the memory 44*b* so as to generate the speech "WELCOME". Next, a step 60 sets the timer to 0.5 seconds, and a step 61 discriminates whether the fuel supplying nozzle 29 has been hooked onto the accommodating part 30 after the time of 0.5 seconds has elapsed. When the discrimination result in the step 61 is NO, the operation advances to a step 62. The predetermined counted value which has been stored in the step 53, is read out from the predetermined memory region (address FFH), and the pulses from the flow quantity generator 26 are counted, in the step 62. The step 62 further discriminates whether the counted value of the pulses from the flow quantity generator 26, is greater than the predetermined counted value of ten pulses, for example, which has been read out from the predetermined memory region. In other words, the step 62 discriminates whether the pulses from the flow quantity generator 26 have been received responsive to the actual opening of the fuel supplying nozzle 29, that is, the actual start of the fuel supply, without erroneously responding to the pulses generated from the flow quantity generator 26 between the time when the pump 16 is started and the time when the fuel supplying nozzle 29 is opened.

In a case where the fuel supplying nozzle 29 is returned to the setp 52, and the waiting state is resumed.

When the discrimination result in the step 62 is NO, the operation is returned to the step 61, and the operation described before is continued until the counted value of the pulses from the flow quantity generator 26 becomes greater than the predetermined counted value read out from the predetermined unhooked from the accommodating part 30 but the fuel supplying nozzle 29 is hooked back onto the accommodating part 30 before the fuel supplying nozzle 29 is opened so as to cancel the fuel supplying operation, the discrimination result becomes YES in one of the steps 55, 58, and 61. As a result, the operation is returned to the step 52, and the waiting state is resumed.

When the discrimination result in the step 62 in NO, the operation is returned to the step 61, and the operation described before is continued until the counted value of the pulses from the flow quantity generator 26 becomes greater than the predetermined counted value read out from the predetermined memory region. When the discrimination result in the step 62 becomes YES, the operation advances to a step 63 shown in FIG. 5B, as indicated by a connector Ⓐ. The melody IC 44*c* is driven and the melody of the desired music which has been selected by the music selection switch 31 is generated during the process of the fuel supply, in the step 63. A subsequent step 64 checks the pulse signal from the flow quantity generator 26, and discriminates whether the pulse signal is absent for over a predetermined duration of one second, for example, so as to determine whether the supply of fuel has been stopped. When the discrimination result in the step 64 is NO, the discrimination in the step 64 is repeated, and the generation of the melody is continued. On the other hand, when the discrimination result in the step 64 becomes YES, that is, when the pulse signal from the flow quantity generator 26 is absent for over one second, it is discriminated that the supply of fuel has stopped, and the operation advances to a step 65. The driving of the melody IC 44*c* is stopped to stop generating the melody, in the step 65.

Next, the pulse signal from the flow quantity generator 26 is checked in a step 66, to determine whether two or more pulses have been received from the flow quantity generator 26. When the discrimination result in the step 66 is NO, a step 67 discriminates whether the fuel supplying nozzle 29 has been hooked onto the accommodating part 30. The operation is returned to the step 66 when the discrimination result in the step 67 is NO. For example, when the fuel supplying nozzle 29 is closed automatically when the fuel tank of the vehicle becomes full, but the fuel supplying nozzle 29 is opened manually so as to supply some more fuel and fill the fuel tank to the full capacity, pulses are generated from the flow quantity generator 26. When two of such pulses are counted, the discrimination result in the step 66 becomes YES, and the operation is returned to the step 63. Accordingly, the melody IC 44*c* is driven again, and the melody is generated. When this manually resumed fuel supply is terminated by closing the fuel supplying nozzle 29, the discrimination result in the step 64 becomes YES, and the operation advances to the step 67 through the steps 65 and 66.

When the fuel supplying nozzle 29 is hooked onto the accommodating part 30, the discrimination result in the step 67 becomes YES, and a subsequent step 68 sets the timer to 0.5 seconds. After this set time of 0.5 seconds elapses, a step 69 discriminates whether the fuel supplying nozzle 29 has been unhooked from the accommodating part 30. The discrimination result in the step 69 is NO when the fuel suppling nozzle 29 remains hooked onto the accommodating part 30. In this case, the melody IC 44*c* is driven in a step 70, and a step 71 sets the timer to 0.5 seconds. After this set time of 0.5 seconds elapses, a step 72 discriminates whether the fuel supplying nozzle 29 has been unhooked from the accommodating part 30. When the fuel supplying nozzle 29 remains hooked onto the accommodating part 30, the speech synthesizer 44*a* is driven in a step 73, and an access is made to the memory 44*b* so as to inform the customer of the quantity of supplied fuel by generating the speech "SUPPLIED FUEL IS 10.0 LITERS", for example, through the speaker 17. Next, the timer is set to 0.5 seconds in a step 74, and a subsequent step 75 discriminates whether the fuel supplying nozzle 29 has been unhooked from the accommodating part 30 after the set time of 0.5 seconds elapses. When the fuel supplying nozzle 29 remains hooked onto the accommodating part 30, the operation advances to a step 76. In the step 76, the speech synthesizer 44*a* is driven, and an access is made to the memory 44*b* so as to inform to the customer the same quantity which was informed previously in the step 73. In other words, the quantity of supplied fuel is informed to the customer twice. A step 77 sets the timer to 0.5 seconds, and the operation advances to a step 78 after the set time of 0.5 seconds elapses. The step 78 discriminates whether the fuel supplying nozzle 29 has been unhooked from the accommodating part 30. When the fuel supplying nozzle 29 remains hooked onto the accommodating part 30, the discrimination result in the step 78 is NO, and a greeting which should be given upon completion of the fuel supplying operation, such as "THANK YOU VERY MUCH", is generated through the speaker 17 in a step 79. Thereafter, the operation is returned to the step 52 shown in FIG. 5A, through a connector Ⓑ shown in FIG. 5B.

The operations described heretofore are performed during one normal cycle of the fuel supplying operation. However, the fuel supplying nozzle 29 may once be hooked onto the accommodating part 30 upon completion of one fuel supplying operation, and the fuel supplying nozzle 29 may be unhooked from the accommodating part 30 so as to start the subsequent fuel supplying operation, before the greeting "THANK YOU VERY MUCH" is generated in the step 79 with respect to the previous (last) fuel supplying operation. In this case, the discrimination result becomes YES in one of the steps 69, 72, 75, and 78, and the operation advances to the step 53 through a connector Ⓒ shown in FIG. 5A. Accordingly, from the time when the fuel supplying nozzle 29 is unhooked from the accommodating part 30, the speech generating operation up to the step 79 is not performed, and the subsequent fuel supplying operation can be started immediately.

Each of the steps for discriminating whether the fuel supplying nozzle 29 is in the hooked or unhooked state, are executed according to discriminating programs which are stored in a memory within the display processing device 41. These discriminations are performed according to open and closed states of the nozzle switch 14 which is located within the accommodating part 30 and opens and closes responsive to the hooking and unhooking of the fuel supplying nozzle 29. On the other hand, each of the discriminating steps related to the pulse signal from the flow quantity generator 26, are performed according to predetermined discriminating programs, based on the pulse signal from the flow quantity generator 26.

The programs for discriminating the hooked and unhooked states of the fuel supplying nozzle 29, are only one example of realizing the discriminating operations in the present invention, and these programs are determined by the actual processing operations performed in each of the steps. In addition, the waiting state is continued or discontinued in the step 52, but the present invention is not limited to this embodiment in which the fuel supplying operation is started from the step 53 and the discrimination on the actual fuel supply is performed in the step 62.

In the present embodiment, the hooked and unhooked states of the fuel supplying nozzle 29 are discriminated in correspondence with the predetermined durations which are set in the timer, so as to continuously perform the successive fuel supplying operations. However, the hooked and unhooked states of the fuel supplying nozzle 29 may be discriminated independently of the setting of the timer, and other means may be taken.

Further, the present invention is not limited to these embodiments, but various variations and modifications may be made without departing from the scope of the present invention.

What is claimed is:

1. A fuel supplying apparatus comprising:

a fuel supplying nozzle having an opening and closing valve;

fuel supplying means for supplying a fuel to said fuel supplying nozzle;

a nozzle hook onto which said fuel supplying nozzle is hooked when said fuel supplying nozzle is not in use;

flow quantity signal generating means for generating a flow quantity signal responsive to a quantity of fuel which has been supplied from said fuel supplying means;

speech generating means for generating a speech which is in accordance with a completion of a fuel supplying operation, responsive to a hooking of said fuel supplying nozzle onto said nozzle hook after the fuel supplying operation is completed; and resetting means for stopping the generation of speech by said speech generating means and for resetting the fuel supplying apparatus to a state where a subsequent fuel supplying operation can be started, responsive to an unhooking of said fuel supplying nozzle from said nozzle hook before the generation of speech by said speech generating means is completed.

2. A fuel supplying apparatus as claimed in claim 1 in which said speech generating means generates a synthesized speech which informs a quantity of supplied fuel responsive to the flow quantity signal from said flow quantity signal generating means.

3. A fuel supplying apparatus as claimed in claim 2 in which said speech generating means generates a sound which indicates the completion of the fuel supplying operation and a synthesized speech which is related to a greeting given after completion of the fuel supplying operation.

4. A fuel supplying apparatus as claimed in claim 1 in which said resetting means discriminates in a plurality of steps whether said fuel supplying nozzle has been unhooked from said nozzle hook after said fuel supplying nozzle is hooked onto said nozzle hook until a time when said speech generating means generates a final speech, and said fuel supplying apparatus is put into the state where the subsequent fuel supplying operation can be started in a certain step when one of said plurality of steps discriminates that said fuel supplying nozzle has been unhooked from said nozzle hook.

5. A fuel supplying apparatus as claimed in claim 1 in which said speech generating means comprises memory means for pre-storing information related to a first greeting which is to be given before the fuel supplying operation is started, one or a plurality of melodies, and a second greeting which is to be given after the fuel supplying operation is completed, and said speech generating means generates the first greeting when said fuel supplying nozzle is unhooked from said nozzle hook, one of said plurality of melodies while the valve in said fuel supplying nozzle is open and the fuel supplying operation is being performed, and the second greeting when said fuel supplying nozzle is hooked back onto said nozzle hook.

6. A fuel supplying apparatus as claimed in claim 1 in which said nozzle hook comprises a switch which opens and closes responsive to the hooking and unhooking of said fuel supplying nozzle with respect to said nozzle hook, and said resetting means detects that said fuel supplying nozzle has been hooked onto said nozzle hook and has then been unhooked after the fuel supplying operation has been completed, responsive to the open and closed states of said switch, so as to stop said speech generating means from generating the speech which is related to the completion of the fuel supplying operation.

* * * * *